US006434784B1

(12) United States Patent
Wisser

(10) Patent No.: US 6,434,784 B1
(45) Date of Patent: Aug. 20, 2002

(54) PORTABLE DUST COLLECTION SYSTEM FOR COLLECTION OF WOOD FLOOR SANDING DUST

(76) Inventor: David A. Wisser, 1009 Beach Blvd., Forked River, NJ (US) 08731

( * ) Notice: Subject to any disclaimer, the term of this patent is extended or adjusted under 35 U.S.C. 154(b) by 42 days.

(21) Appl. No.: 09/739,161

(22) Filed: Dec. 19, 2000

(51) Int. Cl.[7] ..... A47L 9/24; A47L 5/38
(52) U.S. Cl. ..... 15/314; 15/301
(58) Field of Search ..... 15/301, 312.2, 15/314, 315

(56) References Cited

U.S. PATENT DOCUMENTS 1,048,477 A * 12/1912 Allington
1,553,201 A * 9/1925 Sutton et al.
2,448,834 A * 9/1948 Rousseau
3,086,891 A * 4/1963 McEachern
3,343,197 A * 9/1967 Carsey
3,464,858 A * 9/1969 Hamrick
3,602,938 A * 9/1971 Lindsay
4,222,754 A * 9/1980 Horvat
4,829,626 A * 5/1989 Harkonen
5,353,467 A * 10/1994 Junger
5,606,767 A * 3/1997 Crlenjak
5,940,926 A * 8/1999 Inzinna et al.
6,012,199 A * 1/2000 Litomisky et al.
6,182,326 B1 * 2/2001 Rhea et al.

* cited by examiner

*Primary Examiner*—Terrence R. Till
(74) *Attorney, Agent, or Firm*—Clifford G. Frayne

(57) ABSTRACT

A portable, dust collection system for collection of wood dust generated in a wood floor sanding operation, the system comprising a plurality of portable blower motors comprising the primary static pressure generator positioned in series between the sanding tools and the collection container, this system having a plurality of collection hoses of increasing diameter between the sanding tools and the primary static pressure generator with intermediate blower motors positioned between the hoses where diameters increase, sanding tools having skirts for position thereon in distal proximate contact with the floor such that all dust is collected by the system.

10 Claims, 1 Drawing Sheet

PORTABLE DUST COLLECTION SYSTEM FOR COLLECTION OF WOOD FLOOR SANDING DUST

BACKGROUND OF THE INVENTION

1. Field of the Invention

The present invention relates to wood dust collection apparatus and in particular, to a portable apparatus for collecting wood dust generated as a result of wood floor sanding operation.

2. Description of the Prior Art

Wood dust is classified by the Environmental Protection Agency as a harmful material and inhalation can cause respiratory problems. There exist in the market place dust collection apparatus for use in a wood shop environment where saws, planers, sanders and the like generate dust by virtue of their operation on a piece of wood. In such a wood shop environment, one would expect to generate wood dust and therefore the commercial dust collection systems are generally stationary and the surrounding walls of the wood working shop are devoid of decoration. U.S. Pat. No. 5, 606,767 to Crlenjak and 4,977,638 to Best.

Applicant performs commercial sanding of wooden floors such as hardwood flooring or the like. The work is performed both in a residential and commercial settings. The equipment utilized by Applicant may include multiple sanders, edgers and buffers. Further, the equipment may be used simultaneously in different rooms within a residential setting or in different offices or different floors in a commercial setting. The equipment is generally powered by an electric motor and attempts at collecting the dust particulate from the sanding operation in the past have included bags attached to the sander, edger or buffer which would quickly fill up and require emptying and in the process often resulted in wood dust escaping from the bag or container.

Therefore, there was a need for a centralized collection system for the collection of wood dust generated during the wood floor sanding operation. The collection system must be relatively light weight and portable, yet powerful enough to draw sufficient static pressure to allow the sanders, edgers and buffers to operate in the desired location. The centralized portable system would be desirable when performing work on new construction when the residence or commercial setting has not been decorated and you want to insure that all the wood dust generated from the sanding operation is collected. However, the portable centralized system would be a necessity when one was sanding the floor of a home or office or other commercial setting which was decorated. In those instances, the walls may be painted and have decorative art hung thereon, window treatments may be present, as well as certain furniture which may be incapable of being moved. In such an instance in order to avoid costly and time consuming prep time, (i.e. tape and plastic sheet set up), and clean up, a centralized portable system which would vacuum the wood dust simultaneously with its generation would be required.

Such a centralized portable system would also address safety factors. In a conventional wood sanding operation as is presently available, the ventilation return must be closed and sealed to prevent the excess dust not picked up by the individual machines from being returned through the heating, ventilating and air conditioning system and blocking the system and affecting its efficiency. Still further, the wood dust that is generated from a wood sanding operation is oftentimes very fine and deleterious to the human body if inhaled. Still further, the wood dust collected is combustible.

In Applicant's centralized system, all of the wood dust is collected and the collection container is exterior from the work area. It would either be located outside away from the house, or in a multi-story office dwelling, would most likely be located in a stairwell, which is completely concrete. In either instance, an accidental spark combusting the wood dust would not endanger the home or the office space.

Applicant's centralized system is so efficient that it can be utilized to sand the wood floors of bars, restaurants, banquet halls and clothing stores without the need to remove product or go to the expense of covering all of the product with plastic sheets and tape.

Another advantage of Applicant's centralized system is the electrical hook up for the motors and blowers of the vacuum system and the actual sanding and buffing machines. Because of the voltage and amperage associated therewith, the system bypasses the normal wall outlets and connects directly to the breaker box. This is a further safety feature which allows the user to determine visually any problems with the system and removes the possibility that a machine or blower plugged into a wall outlet causes a short in the wiring which results in a smoldering fire in the wall space.

OBJECTS OF THE INVENTION

An object of the present invention is to provide for a novel portable wood dust collection system for the simultaneous collection of wood dust generated during a wood floor sanding operation.

Another object of the present invention is to provide for a novel wood dust collection system which is modular and portable yet still maintain high static pressure.

A still further object of the present invention is to provide for a novel wood dust collection system from the collection of wood dust generated by wood floor sanding operation that will generate sufficient vacuum to permit the operation of multiple sanders, edgers or buffers simultaneously and collect variable combinations of wood dust encountered (i.e. oily, heavy, fine).

A still further object of the present invention is to provide for a novel wood dust collection system for the simultaneous collection of wood dust from a floor sanding operation which is easily assembled and disassembled for storage and transportation.

SUMMARY OF THE INVENTION

A portable dust collection system for the collection of wood dust generated during a wood floor sanding operation, the system comprising a plurality of portable blower motors comprising primary static pressure generator positioned in series between the sanding tools and collection container, the system having a plurality of collection hoses of increasing diameter between the sanding tools, and the primary static pressure generator with intermediate blower motors positioned between the hoses where diameters increase, which third hose is in communication with said collection container.

BRIEF DESCRIPTION OF THE DRAWINGS

These and other objects of the present invention will become evident, particularly when taken in light o the following illustrations wherein.

DETAILED DESCRIPTION OF THE DRAWINGS

Figure 1:
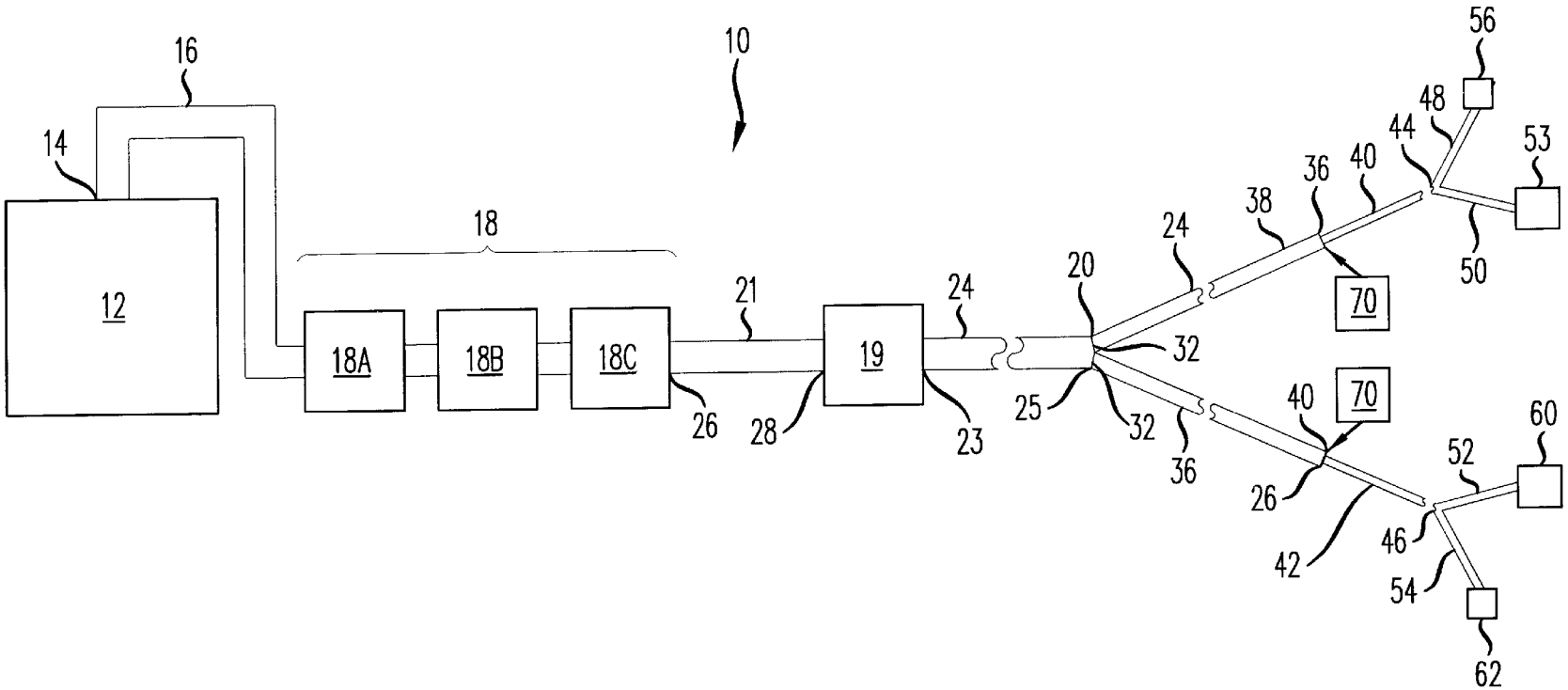
FIG. 1 is a schematic diagram of the dust collection system.

A better appreciation of the dustless collection system of the present invention will be had with reference to FIG. 1, which is a schematic diagram of the collection system 10. The system 10 as designed is portable and allows multiple sanding tools or associated tools to operate at the same time in different locations with all of the dust generated being collected in a central collection container with no dust collecting on the furniture, walls or sills.

The dust collection system as illustrated in FIG. 1 includes a dust collection container 12 in the form of a large bag for the collection of the generated wood dust. This bag could be hung from the vehicle which transports the dust collection system, or hung in a position outside of the home or office such as in the garage or in a stairwell. It is positioned in a location such that in the event of a leak or tear it will not contaminate the work area. It is located outside the building if possible to decrease the possibility of fire since the dust is highly combustible. The dust collection bag 12 has an opening 14 for connection with a first hose member 16. First hose member 16 is in communication with the primary vacuum source 18 for the system. The primary vacuum source consists of three blower motors connected in series. The three blower motors consist of a two horse power blower motor 18A, a one and a half horse power blower motor 18B and a one horse power blower motor 18C, the one horse power blower motor 18C being that which is positioned and connected to hose 16.

From the primary vacuum source 18 and in particular, the two horse power blower motor 18A, there extends a flexible second hose member 21. Second hose member 21 has a first end 26 removably securable to the two horse power blower motor 18A of the primary vacuum source 18 and at its second end 28 it is affixed to a supplementary blower motor 19. From supplementary blower/motor 19 there extends a third hose member 24. The first end 23 of which connects to blower/motor 19 and the second end 25 is fitted with a quick release coupling 30, has a plurality of fittings and openings 32 to accommodate connection of one or more fourth hose members 34 and 36 which are of a lessor diameter than third hose member 24. Hose members 34 and 36 extend from quick release coupling 30 and terminate with a second quick release coupling 36 at each end 38 and 40. Second quick release coupling 36 permits the connection of a hose member 40 and 42 to each of hose members 34 and 36. Hose members 40 and 42 of a lesser diameter than hose members 34 and 36. Hose members 40 and 42 terminate in a third quick release coupling 44 and 46 which again have a plurality of fittings and openings therethrough for the connection of a plurality of fourth hose members 48, 50, 52 and 54. Hose members 48, 50, 52, and 54 are of a lesser diameter than hose members 40 and 42. Hose members 48, 50, 52, and 54 are connected at their terminating ends to the machines being utilized to sand the floors and buff the floors. As shown in the schematic, these machines can include a sander 56, an edger 58, a buffer 60, and a radiator edger 62. Each of the machines are equipped with a skirt about its peripheral edges extending downwardly into contact with the floor and those members 48, 50, 52 and 54 are snap-fit or friction-fit to the upper portion of the respective machines to draw a vacuum from the primary vacuum source 18.

It will be noted that the system allows for the simultaneous operation of four machines. These machines could be all sanders, buffers, or combinations of the four machines set forth herein. It is also possible that in some instances it will not be necessary to assemble the hose system as set forth herein for the operation of four machines simultaneously. In that event, a cap is installed on the appropriate fitting and opening on the quick release coupling to seal off that opening. For example, if one wanted to operate only two machines simultaneously, one of the fittings and openings 30 or 32 in quick release coupling 30 would be sealed and hoses 34, 40, 48, and 50 would be assembled to the respective machines.

In operation, additional blower motors 70 may be interspersed within the system depending upon the length to which the hoses are stretched as determined by the location of the sanding job.

As an example, it has been found that utilizing the primary vacuum source as set forth above, hose 24 can be of a length of 25 feet, hoses 34 and 36 can be of a length of 25 feet, hoses 40 and 42 can be of a length of 25 feet and thereafter hoses 48, 50, 52, and 54 can extend from 60 to 100 feet. In this configuration, the additional blower motors can be installed in the configuration where required, such as at the junction of hose 24 and hoses 34 and 36 or at the juncture of hoses 34 and 36 with hoses 40 and 42 or at the juncture of hoses 40 and 42 with hoses 48, 50, 52, and 54. This intermediate supplementary blower motor would normally be of a one horse power. In this configuration, it has been found that the hose members may be stepped downwardly in diameter size from six inches for the first hose member, to five inches, to four inches, and finally to three inches for the hose member which is removably secured to the sanding machine.

Utilizing the relatively small blower motor horse powers, the system is extremely portable and allows for the quick assembly of the configuration regardless of the layout of the work space. With all of the associated machines having skirts about their periphery and the machines being connected to the hose assembly, all dust generated by the machines is drawn to the collection container 12. The collection container 12 being exterior to the work place, it is thus insured that all dust and sand is collected exteriorly of the work place. This allows for less preparation time in removing furniture and wall decorations and window treatments prior to commencing the work and further allows for the work place to be reset up more quickly after the sanding operation is performed. It eliminates the necessity for plastic throw sheets and taping and eliminates any contamination to the heating, ventilating and air conditioning system.

In operation of the system, there is a requisite for 220 amps. Due to the operation simultaneously of the blower motors and the sanding equipment, it is preferable that the wall sockets not be utilized for operation of the machines. Therefore the system should be connected directly to the source of power for the building. This would be the breaker box in a residential dwelling and such connection can be made utilizing temporary power boxes as known in the trade. This eliminates any possibility for a spark or short to occur in the wall space, which possibility is presented if wall sockets were utilized. Additionally, for ease of maneuverability, the power cord to the sander, buffer, et al, may be run within the flexible conduit attached thereto so that the operator may freely move about with the machine.

While the present invention has been described with respect to the exemplary embodiments thereof, it will be recognized by those of ordinary skill in the art that changes and modifications can be made without divesting from the spirit and scope of the invention. Therefore it is manifestly intended that the invention be limited only the claims and the equivalents thereof.

What is claimed:

1. A vacuum operated dust collection and removal system for hardwood floor sanding operations comprising:

a collection source for wood dust generated by a floor sanding operation;

a primary vacuum source in communication with said collection source;

a secondary vacuum source in communication with said primary vacuum source wherein said communication between said secondary vacuum source, said primary vacuum source, and said collection source comprises a series of first conduit members of a first diameter, said secondary vacuum source having one of said series of first conduit members of said first diameter extending therefrom and terminating in a first splitter coupling;

a plurality of second conduit members of a lesser diameter than and said first conduit member removably secured to said first splitter coupling and extending therefrom said second conduit members of said lesser diameter terminating in a first reducer coupling;

a third conduit member of a lesser diameter than said second conduit member, said third conduit member removably secured to said reducer coupling and terminating in a second splitter coupling; and a plurality of fourth conduit members of lesser diameter than said third conduit member, said fourth conduit members being removably secured to a machine performing an operation on said floor.

2. The vacuum operated dust collection and removal system in accordance with claim 1 wherein said primary vacuum source comprises three blower motors positioned proximate each other in series.

3. The vacuum operated dust collection and removal system in accordance with claim 1 wherein said secondary vacuum source comprises a fourth blower motor positioned down stream from said primary vacuum source.

4. A vacuum operated dust collection and removal system in accordance with claim 1 wherein supplementary vacuum sources may be positioned between said second and third and third and fourth conduit members.

5. The vacuum operated dust collection and removal system in accordance with claim 1 wherein said collection source comprises a collection bag having an inlet port for connection with said first conduit member from said primary vacuum source, said collection bag being positioned exteriorly from said floor sanding operation.

6. The vacuum operated dust collection and removal system in accordance with claim 1 wherein said first conduit, said second conduit, said third conduit, and said fourth conduit members decrease in diameter from six inches, to five inches, to four inches, to three inches respectively.

7. The vacuum operated dust collection and removal system in accordance with claim 1 wherein said first conduit member extends from said secondary vacuum system to said first splitter coupling, a distance proximating 25 feet.

8. The vacuum operated dust collection and removal system in accordance with claim 1 wherein second conduit member extends from said first splitter coupling to said reducer coupling, a distance proximating 25 feet.

9. The vacuum operated dust collection and removal system in accordance with claim 1 wherein said third conduit member extends from said reducer coupling to said second splitter coupling, a distance proximating 25 feet.

10. The vacuum operated dust collection and removal system in accordance with claim 1 wherein said fourth conduit members can each extend a distance of from between 60 to 100 feet.

* * * * *